US006340179B2

(12) United States Patent
Mitchell

(10) Patent No.: US 6,340,179 B2
(45) Date of Patent: Jan. 22, 2002

(54) ADVERTISING MATERIALS AND METHOD FOR COOPERATIVE PROMOTIONS

(76) Inventor: Robert E. Mitchell, 4903 46$^{th}$ Ave., Kenosha, WI (US) 53144

( * ) Notice: Subject to any disclaimer, the term of this patent is extended or adjusted under 35 U.S.C. 154(b) by 0 days.

(21) Appl. No.: 09/799,447

(22) Filed: Mar. 5, 2001

Related U.S. Application Data

(63) Continuation of application No. 09/584,030, filed on May 30, 2000, now abandoned.

(51) Int. Cl.$^{7}$ ..... B42D 15/00
(52) U.S. Cl. ..... 283/67; 283/56; 283/51
(58) Field of Search ..... 283/67, 70, 56, 283/61, 117, 901, 903

(56) References Cited

U.S. PATENT DOCUMENTS 5,780,133 A * 7/1998 Engstrom ..... 283/56 X
5,822,735 A * 10/1998 De Lapa et al. ..... 283/56 X
5,921,584 A * 7/1999 Goade, Sr. ..... 283/56 X

* cited by examiner

*Primary Examiner*—Willmon Fridie, Jr.
(74) *Attorney, Agent, or Firm*—Shughart Thomson & Kilroy P.C.; Mark E. Brown

(57) ABSTRACT

Advertising materials are provided for cooperative promotions. The materials consist of a set of coupons and a promotional piece or flare. Each coupon includes a back face with award structure information printed thereon and a front face with product advertising printed thereon. Each coupon entitles its purchaser to a substantial discount on a product, which discount exceeds the purchase price of the coupon. Multiple break-open windows are formed in the coupon and are movable between closed and open positions respectively concealing and revealing outcome-determining indicia. The indicia comprise symbol combinations and identify respective coupons as either losers or winners entitled to predetermined awards. A cooperative promotional method utilizing the advertising materials is also disclosed.

7 Claims, 6 Drawing Sheets

ADVERTISING MATERIALS AND METHOD FOR COOPERATIVE PROMOTIONS

CROSS-REFERENCE TO RELATED APPLICATION

Continuation of patent application Ser. No. 09/584,030, filed May 30, 2000, now abandoned.

BACKGROUND OF THE INVENTION

1. Field of the Invention

The present invention relates generally to advertising, and in particular to advertising materials and methods for cooperative promotions.

2. Description of the Prior Art

Advertising is a major part of the economy. It plays a significant role in the solicitation of customers for a wide range of commercial enterprises providing various types of goods and services.

The overall objective of an advertising campaign is generally to sell the goods and/or services of the advertiser. The normal strategy for accomplishing this objective is to communicate with customers and potential customers, thereby inducing purchases through a combination of information and persuasion.

A significant challenge faced by advertisers is attracting the attention of prospective customers. Various advertising techniques have been developed to attract the attention of potential customers. Discounted pricing is a common example and can take many forms. For example, reduced-price "sales" are extensively and repeatedly conducted by many mass merchandisers. Discount coupons are also extensively used in merchandising. A typical discount coupon allows a purchaser to obtain a given product at a reduced price, or provides some additional consideration. Rebates comprise yet another form of price discounting.

Another popular advertising technique involves a game or contest played by prospective customers and resulting in monetary or other prizes and awards. Mass merchandisers have employed a number of different promotional methods and types of promotional materials which entertained and motivated prospective customers through the use of such awards. The element of chance in providing such awards tends to stimulate player interest and contributes to the entertainment function of the game materials.

However, heretofore there has not been available an advertising system and method which combines the co-promotional features and the player entertainment aspect of the present invention.

SUMMARY OF THE INVENTION

In the practice of the present invention, advertising materials are provided for use in co-sponsored advertising campaigns. The materials include an advertising display or flare and a coupon set comprising a predetermined number of coupons. Each coupon has a back face with the award structure printed thereon and a front face with advertising for a product and/or service printed thereon. Each coupon includes a plurality of outcome-determining indicia printed thereon and selectively concealed by break-open windows formed in the coupon and accessible at its front face.

In the practice of the method of the present invention, an advertiser initiates a cooperative promotion to sell its goods or services. A promoter identifies retail establishments with customer demographics suitable for the advertised goods and/or services. The materials are designed and manufactured for distribution to the retail establishments. Customers playing the coupons are entertained by the element of chance involved in the selection of winning and losing coupons, which are distinguished by the indicia printed thereon. The advertising materials are purchased in sets by the retail establishments, which resell the individual coupons to their customers. The purchase prices of the individual coupons are less than the value of the coupons, which can permit their purchasers to procure goods and/or services at substantial discounts. The coupons have serial numbers printed thereon for tracking sales data, such as the retail establishments and locations which generate the highest volume of product orders. Customers are entertained by the chance outcome aspect of the coupons, with the possibility of receiving a substantial award. Customers are also directly exposed to advertisers' messages whereby both product and coupon sales are promoted and encouraged.

OBJECTS AND ADVANTAGES OF THE INVENTION

The principal objects and advantages of the present invention include: providing advertising materials for cooperative promotions; providing such materials in sets of predetermined numbers of coupons; providing such coupons with selectively hidden indicia; distinguishing winning and losing coupons by such indicia; providing a cooperative advertising method utilizing sets of coupons; providing such a method which utilizes distribution networks consisting of retail establishments; providing such a method which provides a considerable amount of retail customer/purchaser entertainment; providing such a method which provides a relatively large amount of direct customer exposure for the advertiser; providing such a method which accommodates marketing the coupons in selected retail establishments; providing such a method which facilitates tracking sales data from retail sales of the coupons; and providing such a method which is highly cost effective for the potential results.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1A:
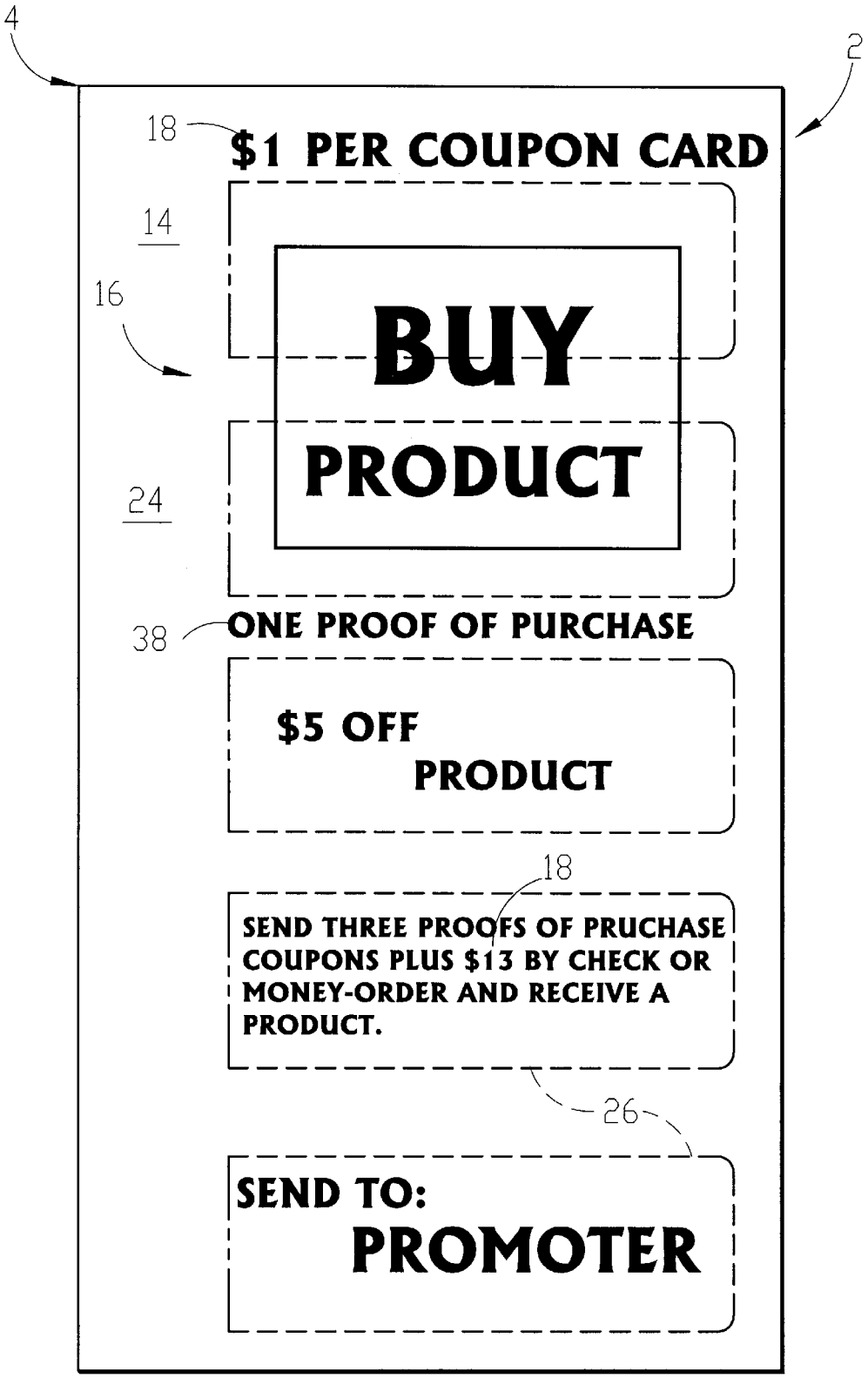
FIG. 1*a* is a front elevational view of a coupon of a set of advertising materials embodying the present invention, showing windows thereof in their closed positions.
Figure 1B:
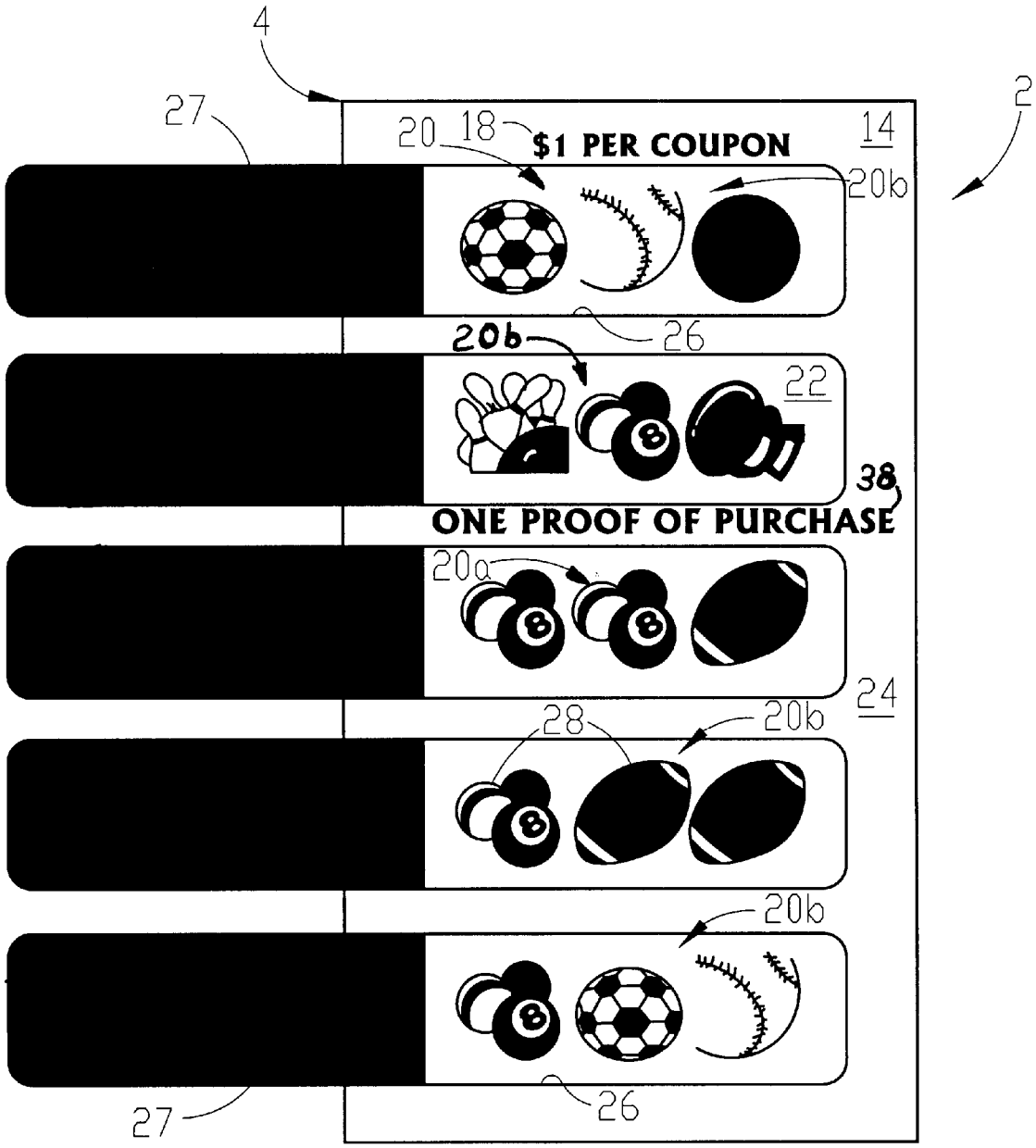
FIG. 1*b* is a front elevational view of the coupon, showing the windows in their open positions.
Figure 2:
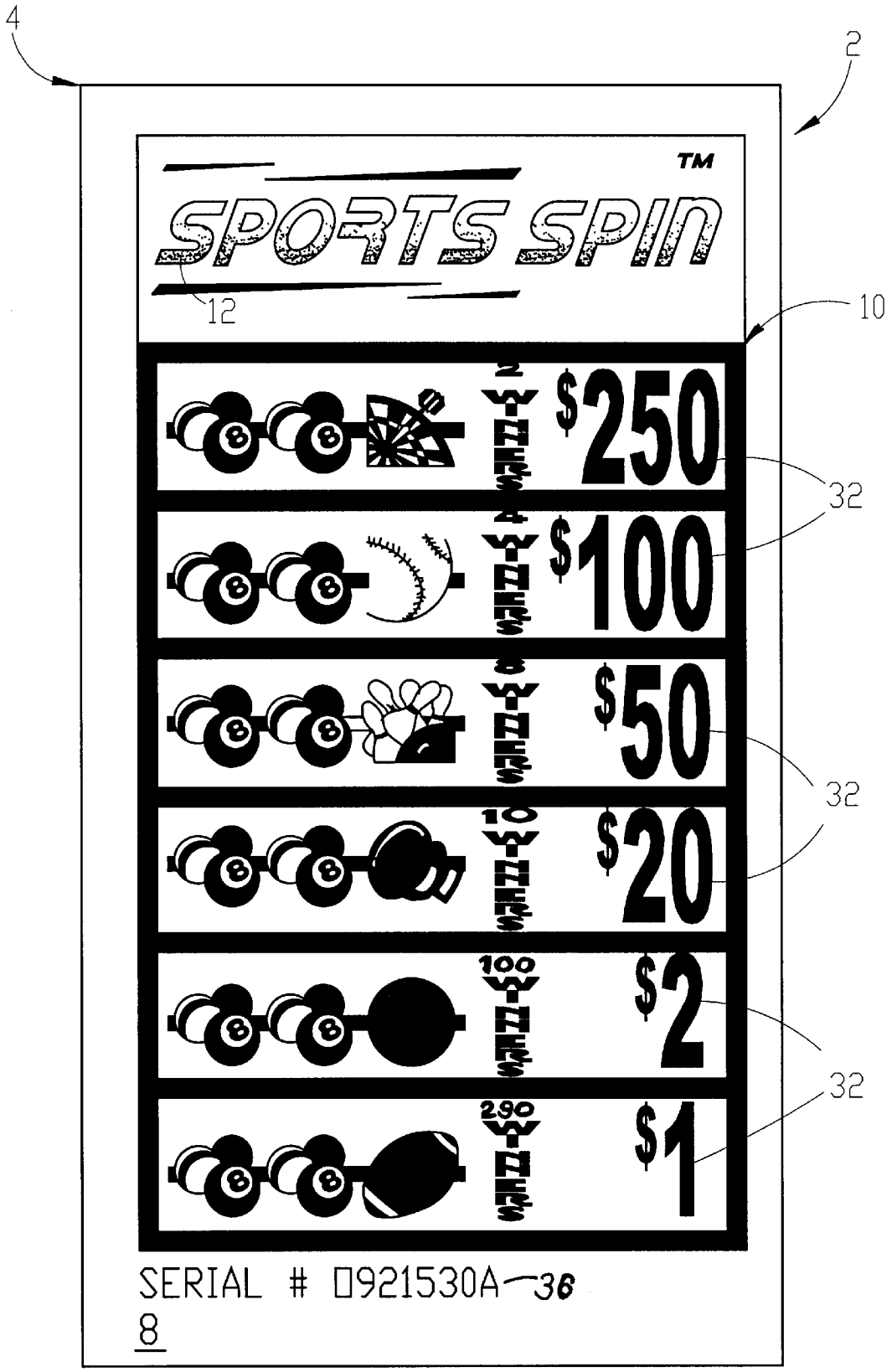
FIG. 2 is a rear elevational view of the coupon.
Figure 3:
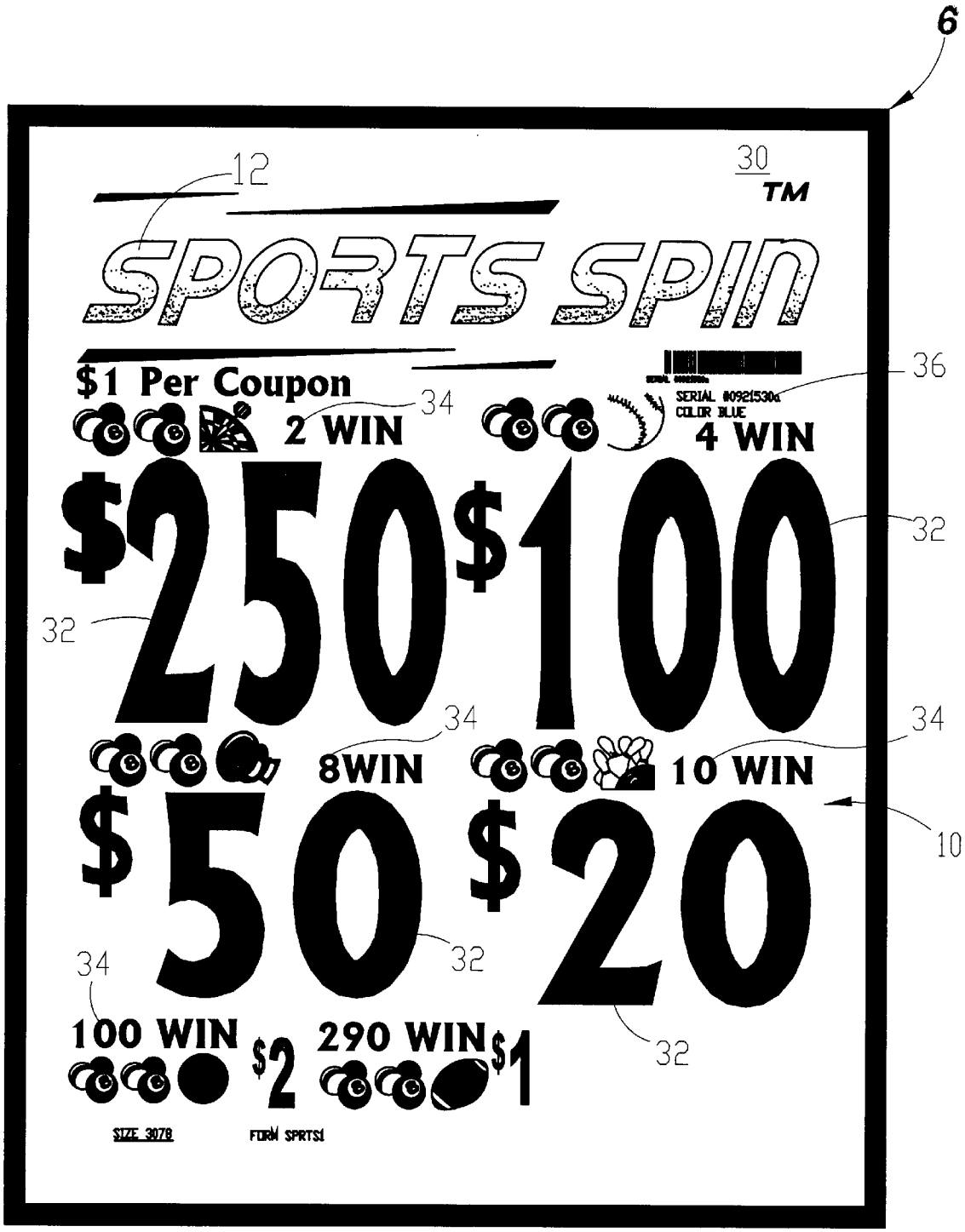
FIG. 3 is a front elevational view of a display or flare depicting the award structure.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 2 generally designates a set of advertising materials embodying the present invention. The advertising material set 2 can be used, for example, for cooperative promotions among different business entities. The advertising material set 2 generally comprises a plurality of coupons 4 comprising a coupon set. Typical sets of coupons range from several hundred to several thousand or more. The advertising materials also include a display or flare 6 for promoting sales of the coupons 4, the game and for identifying an award structure.

II. Coupons 4

The set includes a predetermined number of coupons 4, with an award structure comprising predetermined numbers of winners of different award amounts. Without limitation on the generality of various award structures, the disclosed game materials provide for two winners of $250 each, four winners of $100 each, eight winners of $50 each, ten winners of $20 each, one hundred winners of $2.00 each and two hundred and ninety winners of $1.00 each. The winning coupons 4 are disbursed among a total of 3,078 coupons 4 in the entire set. The coupons have selling prices of, for example, $1.00 each.

Each coupon 4 has a back face 8 with the award structure 10 of award values 32 printed thereon. The name of the promotion (e.g., "Sports Spin") is also printed on the back face 8 at 12.

A front face 14 of the coupon 4 includes product advertising 16 printed thereon and a selling price 18 for the coupon 4. The product advertising 16 can comprise a "proof-of-purchase" form wherein customers are required to purchase a predetermined number of coupons 4 in order to receive favorable pricing on an advertised product. As used herein, "product" refers to goods and/services.

The coupons 4 include structure for selectively concealing indicia 20 for determining an award, if any, for the customer. Thus, the indicia 20 include both "win" and "lose" indicators 20*a,b*. In the illustrated embodiment, the coupons 4 are two-ply construction with back and front panels 22,24 providing the back and front faces 8,14 respectively. The indicia 20 are printed on the inside face of the back panel 22 and are selectively concealed by break-open windows 26 formed in the front panel 24. The windows 26 have closed and open positions respectively concealing and revealing the indicia 20 by means of removable tabs 27. The windows 26 are movable between closed positions concealing respective indicia 20 and open positions revealing same.

Each indicia 20 comprises a plurality (e.g. three are shown) of symbols 28, with certain symbol combinations (e.g., 20*a*) comprising winners associated with respective award values 32. A serial number 36 associated with the advertising material set 2 is printed on the back face 8 of each coupon 4. A proof of purchase statement 38 is printed on the front face 14 of each coupon 4 and serves to remind the purchaser of the value of the coupon 4.

Various other structures and devices for selectively concealing the indicia 20 can be employed with the present invention. The disclosed construction is relatively efficient and cost effective. Moreover, the two-ply panel construction employed provides ample area for multiple windows 26, such as the five which are shown.

III. Flare 6

The flare 6 includes a front face 30 with the award structure 10 printed thereon. The award structure 10 consists of the award values 32, the winning indicia 20*a*, and the number of winners entitled to each award value 32, identified by the reference numeral 34. The promotion name 12 is also prominently displayed on the flare 6. As shown, the higher award values 32 are very prominently displayed in order to attract customer interest. The serial number 36 printed on the individual coupons 4 is also printed on the flare front face 30.

IV. Cooperative Promotional Methodology

Figure 4:
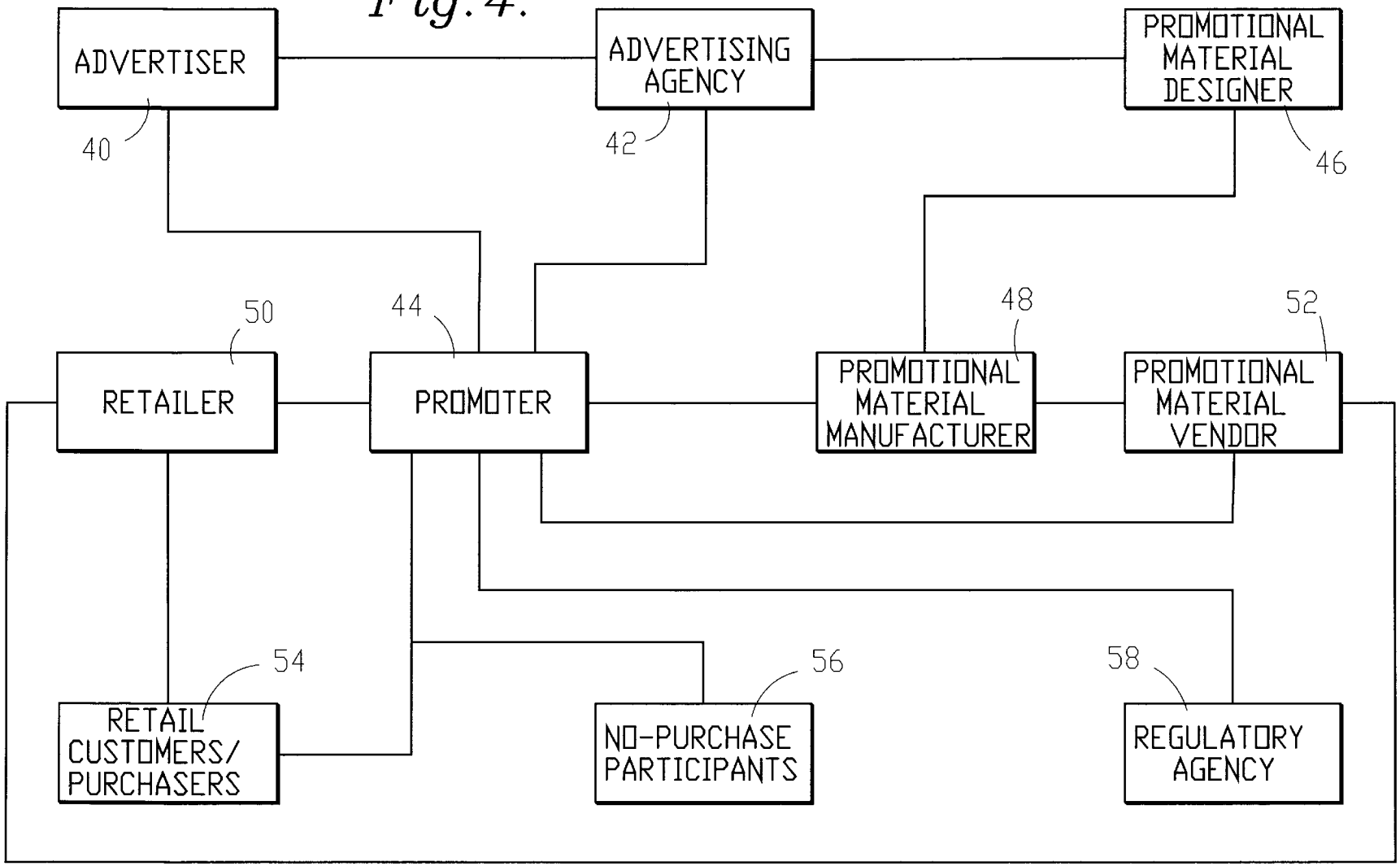
FIG. 4 is a schematic diagram of the various entities involved in the cooperative advertising method of the present invention.

A cooperative promotional advertising method using the advertising material set 2 is disclosed. FIG. 4 is a schematic diagram of the main participants. An advertiser 40 can be any entity with a product, i.e. goods and/or services, to sell. The advertiser 40 can involve an advertising agency 42, which would engage the promoter 44. Alternatively, the advertiser 40 can deal directly with the promoter 44. The advertising materials 2 are designed by a material designer 46 for production by a material manufacturer 48. A design for the advertising materials 2 would include such features as the name, the total coupon count, the award structure, the graphics, and the product advertising 16.

In addition to arranging for the advertising materials 2, the promoter 44 arranges for their distribution to retail entities 50. Since the retail entities 50 sell the coupons 4 in order to generate revenue and also to increase traffic in their establishments, the retailers 50 comprise a second or additional advertiser whereby a synergistic, co-promotion of goods and services of the primary advertiser 40 and the retailer 50 is achieved. The advertising materials 2 can be provided to the retailer 50 by a vendor 52, such as a distributor who represents a game manufacturer 48.

Customers 54 of the retailer 50 can comprise the purchasers of the coupons 4. Thus, the retailers 50 can be carefully chosen for their customer profiles and demographics. For example, the goods and/or services of the advertiser 40 can be matched with retailers 50 whose customers 54 would be most likely to purchase the advertised goods and/or services from the coupons 4. For example, the advertised goods and/or services can correspond to the goods and/or services of the retailer 50 whereby significantly greater redemption of the coupons 4 can occur from a targeted group of potential customers 54. Moreover, retailers 50 with multiple retail store locations can carry the materials 2, and can distribute same according to the demographics of their various locations. The serial numbers 36 provide a means for tracking the sales of the advertising material sets 2. For example, the promoter 44 can monitor the volume of redeemed coupons 4, and using the serial numbers 36 printed thereon, can determine which retailers 50 received the corresponding advertising material sets 2 from which the redeemed coupons 4 were sold. Such information can be utilized to quantitatively monitor the success of the entire advertising campaign. Valuable market research can be generated thereby.

In addition to the regular retail customers 54 who purchase the coupons 4, gaming laws and regulations in some areas require that the coupons 4 be available to participants 56 who do not make purchases. Such no-purchase participants 56 can be accommodated by the promoter 54, who can receive their "entries" in the promotion and make awards as appropriate. The promoter 44 can also handle regulatory agency 58 approvals, permits, licenses, etc.

Figure 5:
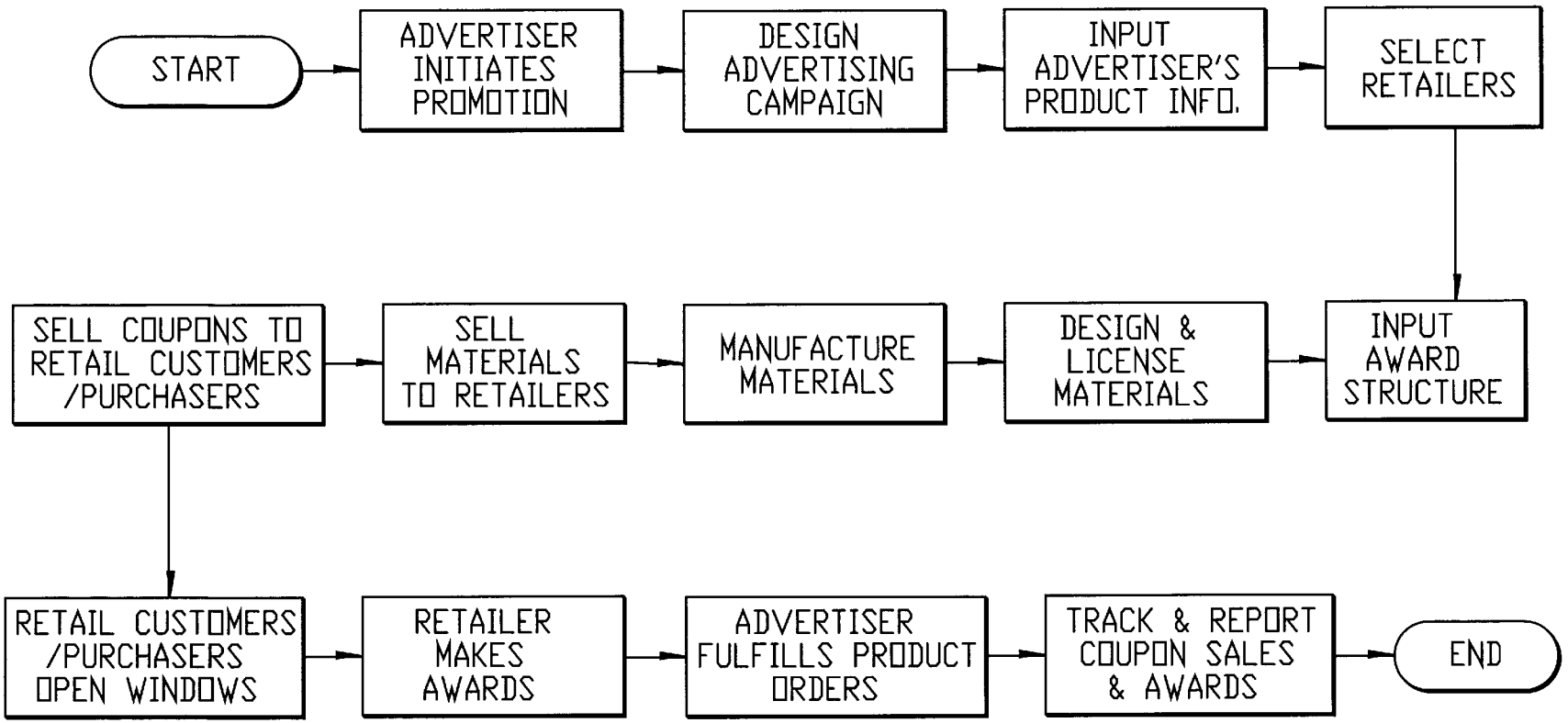
FIG. 5 is a flow chart depicting the cooperative advertising method of the present invention.

FIG. 5 is a flow chart of the co-promotional method of advertising of the present invention. The method is started by an advertiser 40 initiating a promotion of its goods and/or services. An advertising campaign is designed, with input from the product information provided by the advertiser 40. The retailers 50 are selected according to various demographic, marketing and related criteria. The design and license of the award structure and the advertising/promotional materials 2 is accomplished to most effectively market the goods and/or services of the promoter 44 and to create the broadest possible appeal to the customers 54 of the retailers 50. The materials 2 are manufactured by a material manufacturer 48 and are sold and distributed to the retailers 50 through a network of vendors or distributors 52.

At the retail level the coupons 4 are sold to the retail customers 54. The retailers 50 can participate in the promotion of the coupons 4 by displaying the advertising flares 6 associated therewith and by various other advertising methodologies, including print, broadcast media, direct mail, etc.

The coupons 4 are played by the customers 54 who receive awards from the retailers 50. Since coupon 4 has a value in excess of its purchase price, the customers 54 are enticed to order the goods and/or services promoted thereon from the advertiser 40 identified thereon. Moreover, a significant entertainment component is provided in the course of playing the materials 2 since the element of chance adds considerably to the interest and motivation of the customers 54.

Finally, the advertiser 40 can take advantage of the sales data by tracking serial numbers 36 of coupons 4 redeemed and thereby determine which retail establishments 50 are most effective for the purposes of the promotion. For example, geographic locations, types of retail establishments and other factors can be taken into account whereby the advertiser 40 can maximize its revenue from conducting such promotions.

It is to be understood that while certain forms of the present invention have been illustrated and described herein, it is not to be limited to the specific forms or arrangement of parts described and shown.

What is claimed and desired to be secured by Letters Patent is as follows:

1. A cooperative promotional advertising material set, which comprises:

a. a plurality of break-open coupons each having outcome-determining indicia printed thereon;

b. each coupon having a break-open window with closed and open positions selectively concealing and revealing said indicia;

c. a plurality of said break-open coupons having losing indicia;

d. a plurality of said break-open coupons having winning indicia associated with respective awards;

e. proof-of-purchase information printed on said coupons and entitling their purchasers to discounted products; and f a point-of-purchase promotional display with said indicia and the awards associated therewith printed thereon.

2. The invention of claim 1, which includes:

a. each said indicia comprising a plurality of individual symbols comprising a respective symbol combination.

3. The invention of claim 1, wherein each said coupon includes a plurality of said break-open windows each selectively concealing an indicia.

4. The invention of claim 1, wherein each said coupon includes:

a. a back face with said indicia and the awards associated therewith printed thereon;

b. a front face with said advertising printed thereon; and c. said break-open window being formed on said coupon front face.

5. The invention of claim 1 wherein each said coupon and said promotional display have a corresponding serial number printed thereon.

6. A co-promotional advertising method, which comprises the steps of:

a. initiating an advertising campaign with a first promoter;

b. selecting a product of said first advertiser for promotion;

c. selecting a retail sales entity as a second promoter;

d. providing a plurality of coupons with said first promoter's product information thereon;

e. distributing a set of said coupons to said retailer;

f. selling said coupons to retail customers;

g. providing said coupons with awards and award-determining, selectively concealed indicia;

h. opening said indicia concealing structure on said coupons to reveal said indicia;

i. distributing said awards to said retail customers with coupons bearing winning indicia; and j. fulfilling product orders by said first promoter.

7. A cooperative advertising method, which includes the steps of:

a. providing an advertiser with a product;

b. engaging an advertising agency to advertise said product;

c. engaging a promoter to promote said product;

d. engaging a designer to design a set of advertising materials;

e. providing a set of advertising materials including a predetermined number of coupons and a point-of-purchase advertising display;

f. providing each said coupon with front and back faces and a plurality of break-open windows accessible from said front face; and g. printing on said front face an advertisement for purchase of said product at a savings greater than the price of said coupon.

* * * * *